US011540683B2

(12) United States Patent
Fadel

(10) Patent No.: US 11,540,683 B2
(45) Date of Patent: Jan. 3, 2023

(54) PORTABLE GLUE VACUUM RESERVOIR AND VACUUM TOOL WITH CAPTURE RESERVOIR

(71) Applicant: Habib Jose Fadel, Tampa, FL (US)

(72) Inventor: Habib Jose Fadel, Tampa, FL (US)

( * ) Notice: Subject to any disclaimer, the term of this patent is extended or adjusted under 35 U.S.C. 154(b) by 408 days.

(21) Appl. No.: 16/766,321

(22) PCT Filed: Nov. 27, 2018

(86) PCT No.: PCT/US2018/062667
§ 371 (c)(1),
(2) Date: May 22, 2020

(87) PCT Pub. No.: WO2019/104349
PCT Pub. Date: May 31, 2019

(65) Prior Publication Data

US 2020/0359862 A1 Nov. 19, 2020

Related U.S. Application Data

(60) Provisional application No. 62/590,894, filed on Nov. 27, 2017.

(51) Int. Cl.
*A47L 7/00* (2006.01)
*A47L 5/36* (2006.01)
*A47L 9/12* (2006.01)

(52) U.S. Cl.
CPC ..... *A47L 7/0014* (2013.01); *A47L 5/36* (2013.01); *A47L 7/0023* (2013.01); *A47L 9/127* (2013.01)

(58) Field of Classification Search
CPC ..... A47L 7/0014; A47L 5/36; A47L 7/0023; A47L 9/127
See application file for complete search history.

(56) References Cited

U.S. PATENT DOCUMENTS

| | | | | |
|---|---|---|---|---|
| 5,005,252 | A | 4/1991 | Steiner et al. | |
| 5,031,266 | A | 7/1991 | Tillman et al. | |
| 2002/0108205 | A1* | 8/2002 | Berfield | A47L 5/365 15/328 |
| 2007/0160833 | A1 | 7/2007 | Maak et al. | |
| 2007/0271724 | A1 | 11/2007 | Hakan et al. | |

OTHER PUBLICATIONS

International Report on Patentability in PCT/US2018/062667 dated Jun. 2, 2020.
International Search Report and Written Opinion in PCT/US2018/062667 dated Feb. 6, 2019.

* cited by examiner

*Primary Examiner* — Andrew A Horton
(74) *Attorney, Agent, or Firm* — Ted Whitlock; Registered Patent Attorney, PA

(57) ABSTRACT

Described and shown is an article of manufacture, system and process for the collection and capture of a desired substance, either solid or liquid, such as debris or residue. The present invention is particularly useful for the cleanup of glue or other substance (e.g. excess caulking or silicone sealant) employed during fabrication or construction where one or more components are assembled and affixed together using a fluid adhesive or are sealed together, etc. Additionally, the present invention concerns a vacuum tool comprising a substance capture reservoir in communication with a substance collection conduit and attachable to a vacuum source for the collection and capture of various substances, both liquid and solid.

18 Claims, 6 Drawing Sheets

PORTABLE GLUE VACUUM RESERVOIR AND VACUUM TOOL WITH CAPTURE RESERVOIR

FIELD OF THE INVENTION

The subject application concerns an apparatus as well as an article of manufacture, system and process for the collection and capture of a desired substance, either solid or liquid, such as debris or residue. The present invention is particularly useful for glue cleanup during fabrication or construction of an apparatus comprising one or more components assembled and affixed together using a fluid adhesive, e.g., a liquid glue. On one hand, the present invention concerns an article of manufacture and system that comprises a vacuum source, a collection reservoir, and a collection tip for directly collecting excess fluid adhesive from the site of use of the adhesive. Each of the vacuum source, collection reservoir and collection tip are in vacuum communication with one another, forming a vacuum system for rapid and easy collection of the excess adhesive, silicone sealant, caulking or the like. Additionally, the present invention concerns a vacuum tool comprising a substance capture reservoir in communication with a substance collection conduit and attachable to a vacuum source for the collection and capture of various substances, both liquid and solid.

BACKGROUND OF THE INVENTION

Vacuum systems for collection of liquid are well known in the art and are often referred to as a "wet-vac" or "wet/dry vacuums." However, these vacuums are typically manufactured for cleaning up relatively large volumes of water or other liquid refuse and require a large capacity tank for storing one or more gallons, and typically about five or more gallons, of the collected liquid. The vacuum or suction requirements for a wet/dry vacuum are generally such that adequate negative pressure is created for the use of large intake nozzles and vacuum hoses which are typically 1.25-2.5 inches in internal diameter.

Although these available wet/dry vacuums can be provided with rollers or casters to allow movement and positioning of the reservoir, these machines are not "portable" in the sense that they can be easily carried when the reservoir is filled.

In addition, there are smaller vacuums available for dry refuse, dust, or the like, that are useful for small spills or small cleanup purposes, often referred to as a "handheld-vacuum." Although convenient and useful, these handheld vacuums are not suited for and are generally inoperable for cleaning fluid or liquid spills.

In certain industries, e.g., woodworking or furniture assembly or manufacture, that utilize fluid adhesives (e.g., liquid glue) during the assembly and manufacturing process, there is a lack of, and need for, a handheld, portable wet/dry vacuum for cleanup and collection of excess liquid glue that may seep or ooze from a joint where glue is used to affix together two components of the product. Moreover, craftsman in these industries as well as those engaged in painting and caulking, and especially jobs requiring fine detail work, would benefit from a vacuum tool that avoids the need for cumbersome collection containers such as those seen in the portable small wet/dry vacuums currently available today. Even further, there is also a need for a small and nimble vacuum collection tool that is useful for collecting and capturing substances to be retained, as for example fine particulates or tiny gemstones dropped by a jeweler.

The subject invention addresses this need in the art.

DETAILED DESCRIPTION OF THE INVENTION

Figure 1:
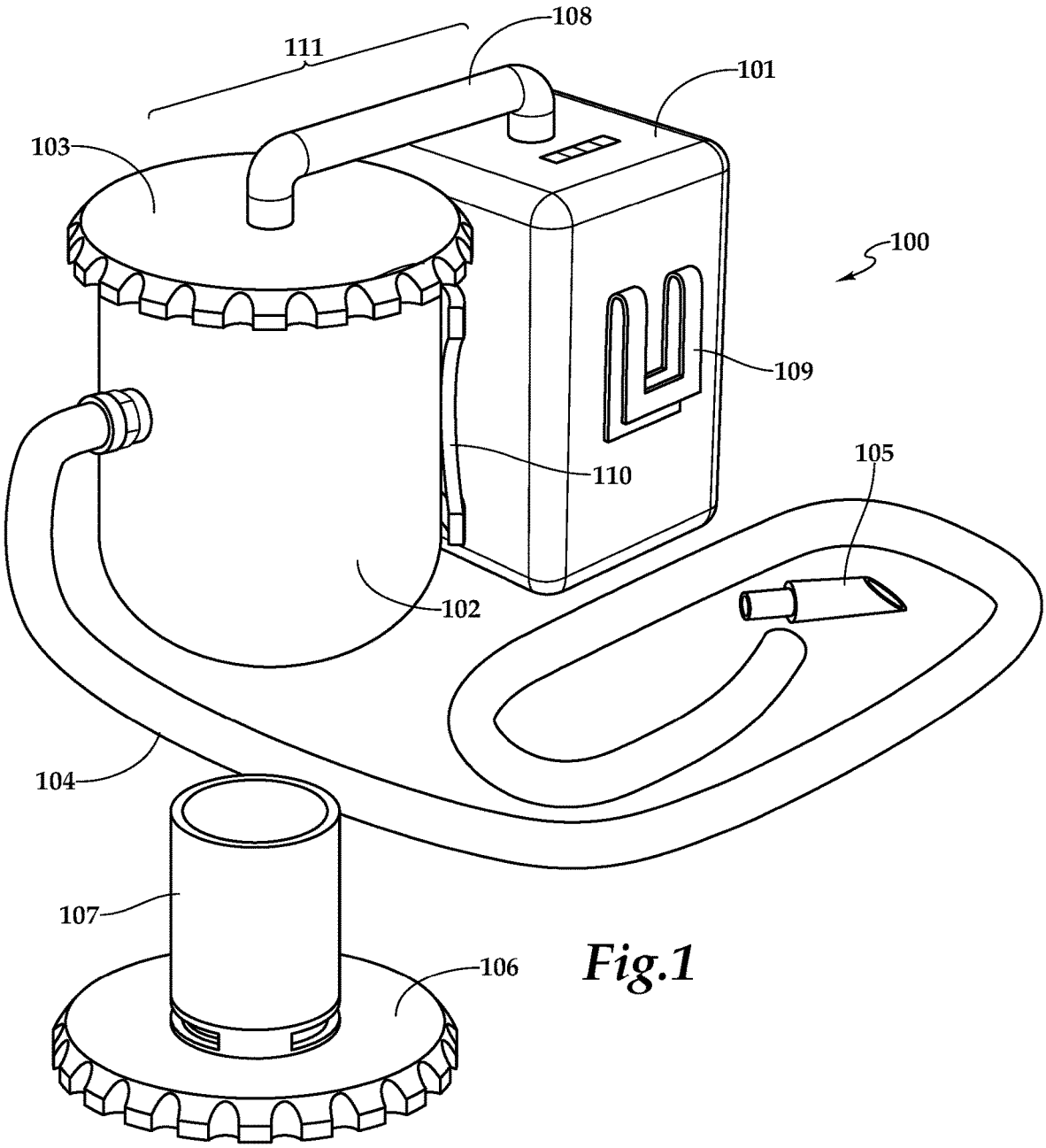
FIG. 1 is a perspective view of a portable vacuum system of the subject invention, comprising the power source, reservoir, and collection tubing and tip, as well as a separate alternative lid configuration adapted for use with a standard wet-vac system.
Figure 2:
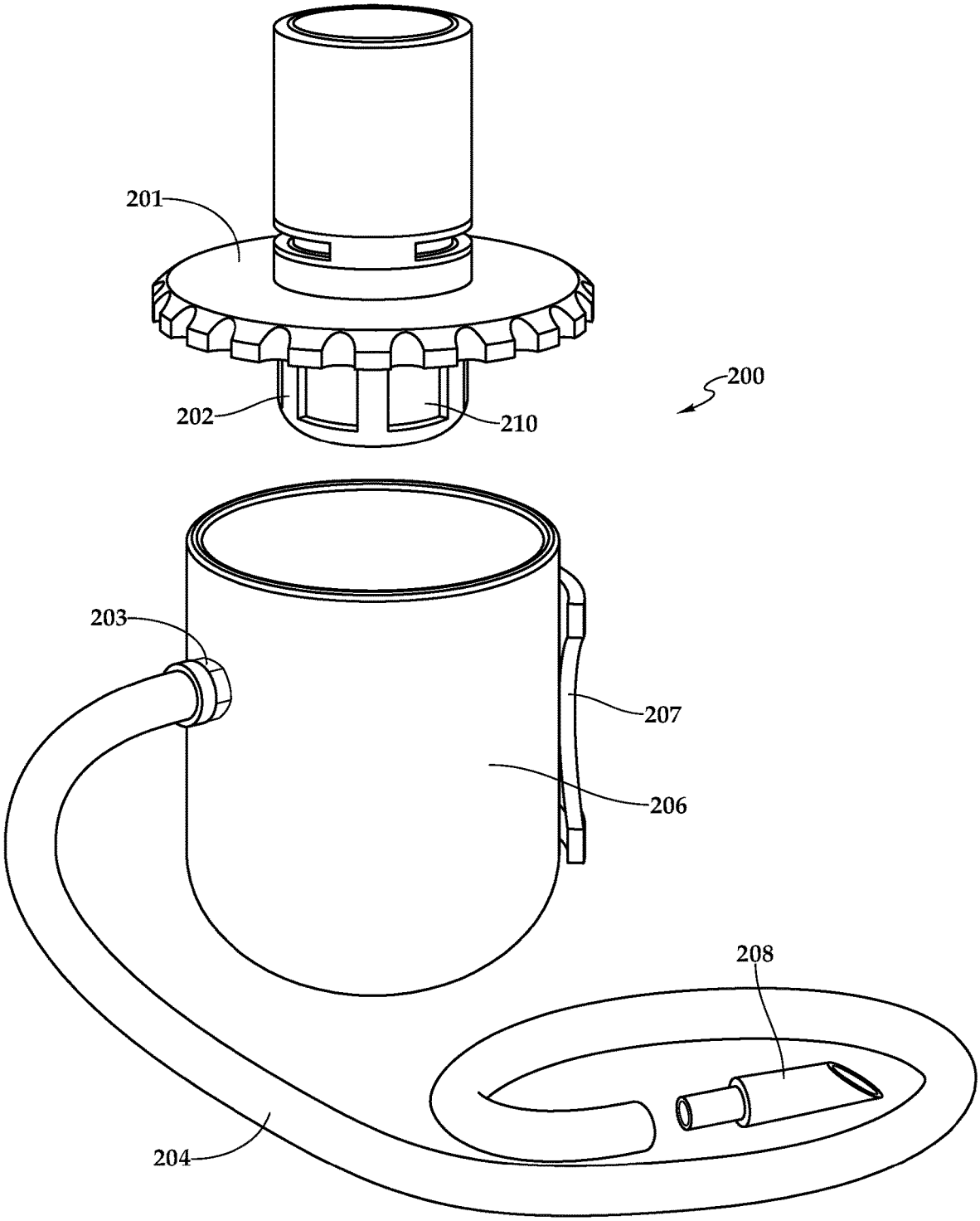
FIG. 2 is a perspective exploded view of an embodiment of a portable vacuum system of the subject invention, illustrating the alternative lid configuration adapted for use with a standard wet/dry vacuum system.
Figure 3:
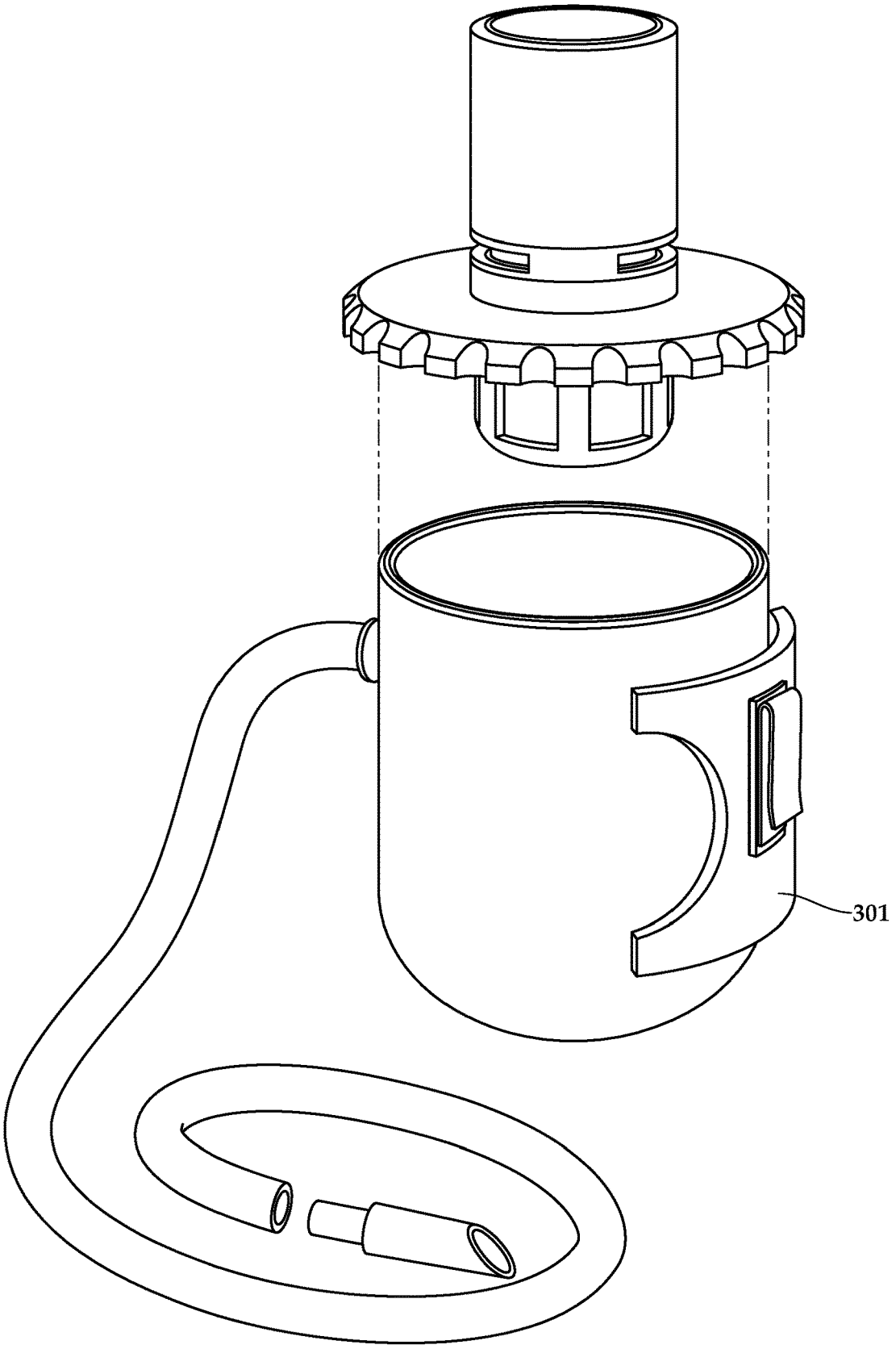
FIG. 3 is a perspective exploded view of an embodiment of a portable vacuum system of the subject invention, comprising the alternative lid configuration of FIG. 2, and illustrating the belt clip for convenient carrying by the user.

Referring to FIGS. 1-3, the vacuum reservoir of the present invention can comprise the following components:

- A reservoir or collection container, for collection and storage of a fluid adhesive, such as liquid glue,
- A removable reservoir lid adapted for connecting the reservoir with a vacuum source, and connecting
- A collection hose or conduit having a length which is convenient for reaching the intended target from the reservoir, but not so long as to interfere or be inconvenient for its intended use.

Preferably the reservoir or collection container is sized to be portable, meaning that it can be easily held in a user's hand, or clipped to the belt or clothing of the user without restricting the user's movement during use. For example, one embodiment of an appropriately sized container may be about 3-5 inches in width or diameter and about 3-6 inches in height. The reservoir or collection container is preferably made from a rigid plastic or metal and is open at the top for receiving a removable reservoir lid.

The reservoir collection container preferably comprises an inlet port for receiving and connecting the collection hose thereto. Alternatively, the collection hose can be connected to an inlet port provided in the reservoir lid. In a preferred embodiment, the collection tube is affixable to the reservoir or reservoir lid by means of a coupling which can provide for quickly connecting and disconnecting the collection tubing from the reservoir or lid. For example, a brass quick-connect coupler, which is readily commercially available, threads directly into the side of the reservoir, which allows the user to attach and detach the collection hose without the use of any tools.

The reservoir lid preferably forms an air-tight seal when received onto the reservoir, and comprises a vacuum port, for connecting the reservoir to the vacuum source. The inlet port can be adapted in size to receive a connecting hose having a diameter of ¼ to ½ inch to receive a standard plastic or PVC tubing connecting the lid and reservoir to portable vacuum source, or can have a 1-inch to 2½ inch inlet port to receive a standard wet/dry vacuum hose connecting the reservoir and lid to a commercially available wet/dry vacuum system. It would be understood that the reservoir lid can be provided with interchangeable inlet ports of differing sizes or can be provided as separate lids having a fixed inlet port size.

The lid can further comprise an intake filter for preventing the contents collected in the reservoir from being vacuumed into the vacuum source or vacuum motor. The filter is preferably configured onto the inner surface of the lid and is sized to fit within the top opening of the reservoir or collection container without interfering with the air-tight seal.

A preferred system of the subject invention further comprises an air pressure control dial, for regulating the strength of the vacuum pressure. This air pressure control dial can be positioned anywhere in-line of the vacuum system and is preferably configured as part of the reservoir lid.

Additional components of the system can include any number of various collection tips that may be interchangeably attached to the distal end of the collection hose or conduit depending upon the type of substance to be collected, the spatial constraints of the collection area and the like. For purposes of the instant application, the terms "proximal" and "distal" shall indicate either directional movement or the position of device components relative to one another as observed from the perspective of the device operator; proximal being closer to the operator and distal being further from the operator. For purposes of further clarification, a part or component X is said to be "distal from or to" part or component Y when the relative position of part X is more remote or away from the operator than Y when the operator is properly using the device. Exemplary tips would include a suction tip connectable to the collection hose at one end and having a collection port at the other end. The collection port can be narrow or wide, rigid or flexible, as would be readily understood in the art, for providing convenient removal of the fluid adhesive as desired at the site of removal. For example, collection of fluid adhesive from a tight joint may benefit from a narrow or beveled opening in the tip, whereas a wide or larger opening forming the collection port may provide rapid and complete collection of a larger amount of fluid adhesive in a single collection action. Preferable, the system can comprise a plurality of interchangeable suction tips having openings ranging from large or wide collection ports to small or narrow collection ports for convenience of use according to need.

In one embodiment, the reservoir or collection container can have the clip attachment positioned on the outer surface of a side wall of the reservoir, wherein the clip attachment can facilitate attachment of the reservoir to the belt or clothing of the user. The clip attachment can be a separate component affixable to the reservoir side wall or can be integrally formed as part of the reservoir side wall. It would be understood that a clip attachment can be provided on a side wall of a vacuum source as well, or alternatively, at the site of the hose connector.

In one embodiment, the vacuum source and reservoir are affixed together, by way of a connecting arm, and one or both of the vacuum source or reservoir can comprise a clip attachment, so that, together one or both the vacuum source and reservoir can be attached to the belt or clothing of the user such that the system is completely portable and mobile in conjunction with the movement of the user.

In a preferred embodiment, the vacuum port, air pressure control dial and safety intake filter are permanently attached to or integrally formed with the reservoir lid as shown in FIG. 2, for example. This configuration provides a safety feature wherein the filter will completely shut off access to the pump if the reservoir is ever flipped upside down.

In use, the portable glue vacuum system of the subject invention is most efficient while the glue is still in its liquid state. The first step is to attach to the collection hose a suction tip with the shape and size that best suits the task at hand. Affix the collection hose to the reservoir or the reservoir lid and connect the vacuum hose to the vacuum port on the reservoir lid and vacuum source. It is preferred to add a small amount of glue solvent to the bottom of the reservoir. Affix the reservoir lid onto the top of the reservoir and start the vacuum. The vacuum or air pressure can be adjusted to the desired level using the vacuum pressure control dial, and the user can then proceed to cleaning the joint by collecting fluid adhesive through the suction tip. For preferred results, the reservoir and suction tips must be thoroughly cleaned following each use.

FIGS. 1-3 are merely illustrative of the portable glue vacuum reservoir of the present invention and are described in more detail below.

FIG. 1 is a perspective view of a portable vacuum system 100 of the subject invention, comprising the vacuum source 101, reservoir 102 and reservoir lid 103, collection tubing 104 and collection tip 105, as well as a separate alternative lid configuration 106 adapted for use with a standard wet/dry vacuum system via inlet port 107. The reservoir lid and vacuum source are in vacuum communication by means of the vacuum tubing 108. Also shown in FIG. 1 is the attachment clip 109 for affixing the vacuum source to the belt or clothing of the user. This attachment clip can alternatively be provided on the outer side wall of the reservoir. A connecting arm 110 provided on an outer side wall of the vacuum source can be provided and adapted to receive the attachment clip on the reservoir, thereby connecting the vacuum source and reservoir together and forming a single vacuum source/reservoir unit 111.

FIG. 2 is a perspective exploded view of an embodiment of a portable vacuum system 200 of the subject invention, illustrating the alternative (wet-vac-adapted) reservoir lid configuration 201. Also illustrated in FIG. 2 is the filter housing 202 that is affixed to the inner face of the reservoir lid and houses filter unit 210. This embodiment of the system further illustrates a quick-release coupling 203, which connects the collection hose 204 to an inlet port provided in a side wall of the reservoir 206 and, at an opposing position of the outer side wall of the reservoir, an attachment clip 207. A detachable vacuum tip 208, is also illustrated.

This same embodiment of FIG. 2 is also shown in FIG. 3, with the reservoir rotated about 30-45 degrees compared to the view presented in FIG. 2, to show more of the configuration of one embodiment of the attachment clip 301.

Additionally, the present application is directed to a handheld vacuum tool for collection and capture of a substance, liquid or solid. While such a substance is typically refuse or debris to be removed or extracted from a desired work area or assembly site (e.g. excess glue or other adhesive), the vacuum tool of the present invention is similarly useful to collect and capture substances to be retained, as for example fine particulates or tiny gemstones dropped by a jeweler.

Turning now to FIGS. 4-8, vacuum tool 401 of the present invention broadly includes an elongated, hollow collection conduit 403 having a distal collection end 403*a* and a proximal connector end 403*b*. The tool further includes a capture reservoir 405 having internal chamber 406 disposed therein. Reservoir 405 also includes a first end port, 405*a*, located at its distal end and a second end port, 405*b*, located at its proximal end. First end port 405*a* is coupled to proximal connector end 403*b* of collection conduit 403 while second end port 405*b* is available for and capable of attachment to a remote vacuum source 407 by way of a hose or conduit suitable for maintaining adequate vacuum when the vacuum source is in operation.

While the tool is attached to a remote vacuum source, the collection conduit and the vacuum source enjoy an open air communication with one another by way of the internal chamber 406 of capture reservoir 405 such that a vacuum is created through the entire length of the tool from the distal collection end 403*a* of collection conduit 403, where the substance to be collected is accessed and extracted, to the opposite end of the tool where it is attached to the vacuum source. Distal collection end 403*a* of collection conduit 403 may be optionally fitted with collection tip 409 as further described below. Filter 411 (as broken down and shown in FIGS. 4-8 as 411*a*, 411*b* and 411*c*) is disposed within capture reservoir 405 between internal chamber 406 of reservoir 405 second end port 405*b*.

It will be appreciated that while FIGS. 4-8 exemplify capture reservoir 405 as a cylindrical, elongate hollow body, any number of shapes and configurations would be suitable for the reservoir body so long as such shapes and configurations allow for an attachable connection to collection conduit 403 at one end and attachment to remote vacuum source 407 at the other. It will be further appreciated that incorporating a cylindrical, elongate design for capture reservoir 405 preferably provides a user-friendly, ergonomic shape that enables the reservoir to ideally function as a handgrip for the operator while simultaneously serving as a capture reservoir for the substance intended to be collected and captured. In one preferred embodiment, the external surface of capture reservoir 405 may be fabricated with a textured surface or coated with other suitable materials known in the art to serve as a handgrip for the device.

Figure 4:
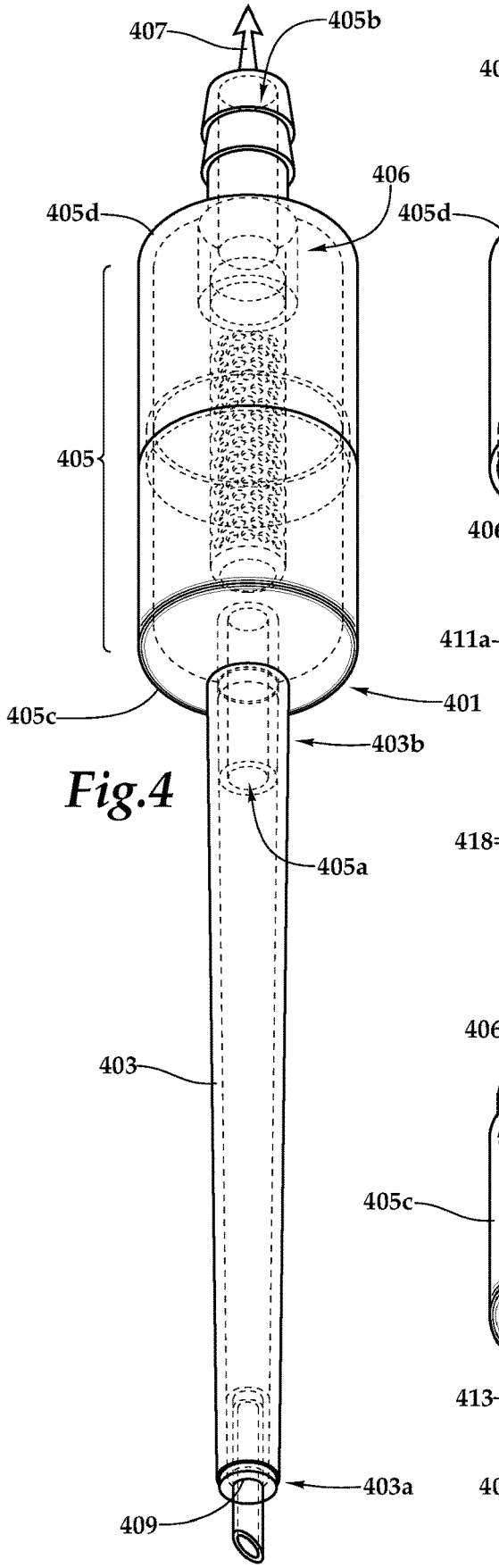
FIG. 4 is a partially exploded perspective view exemplifying a first embodiment of the handheld vacuum tool of the subject invention.
Figure 5:
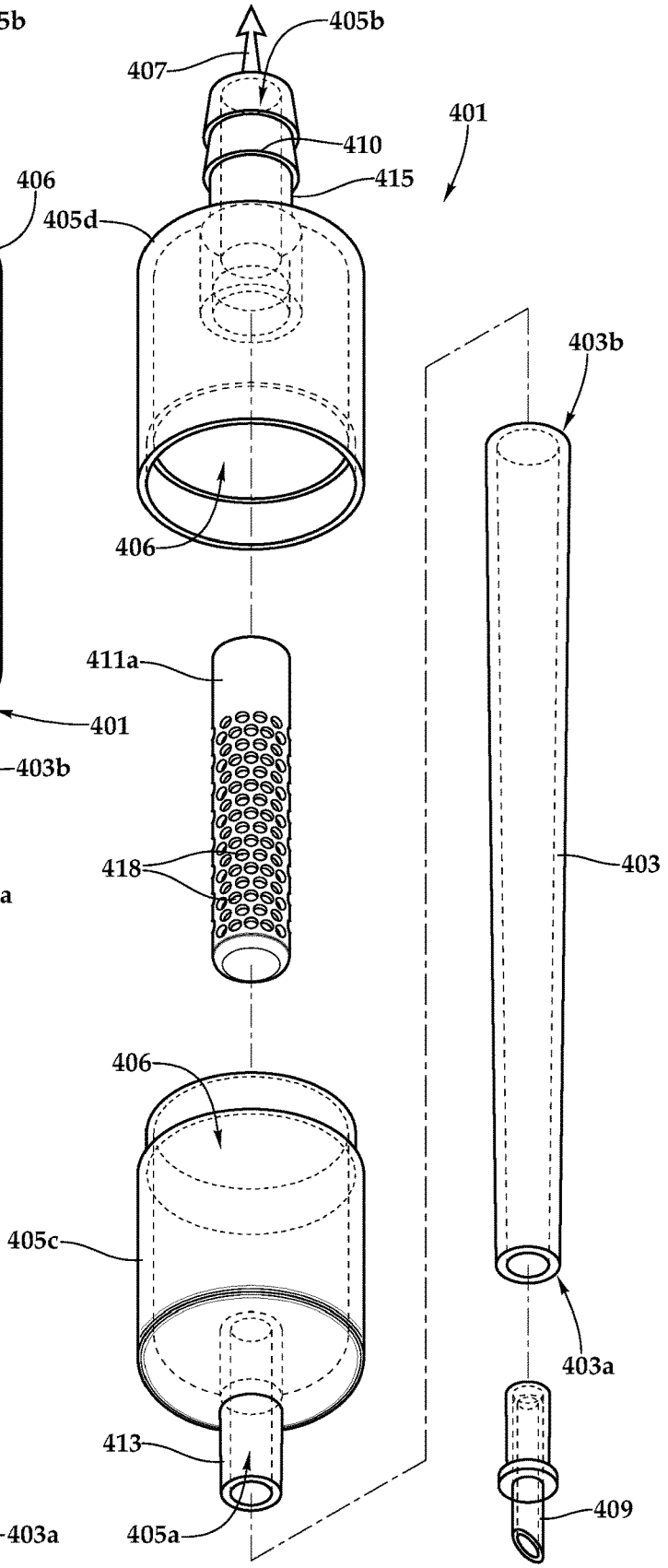
FIG. 5 is a fully exploded perspective view exemplifying a first embodiment of the handheld vacuum tool of the subject invention.
Figure 6:
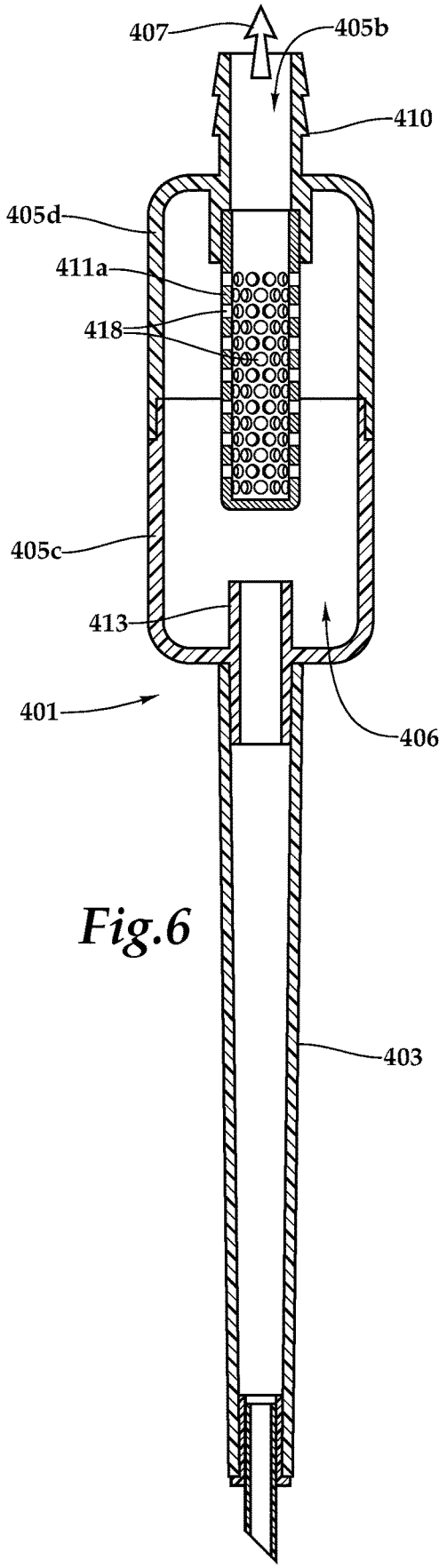
FIG. 6 is a lateral sectional view exemplifying a first embodiment of the handheld vacuum tool of the subject invention.

Turning now to the embodiment shown in FIGS. 4-6, first end port 405*a* is shown coupled to proximal connector end 403*b* of collection conduit 403. While FIGS. 4-6 exemplify only one embodiment to serve as a coupling configuration, any number of suitable coupling arrangements are readily available and known in the engineering arts and the embodiments exemplified in the figures should not serve to limit the invention. For example, such a coupling may be structured as a direct attachment as shown in FIGS. 4-6, whereupon end port 405*a* is fashioned to directly attach to proximal connector end 403*b*. Alternatively, the coupling can be achieved indirectly by way of one or more suitable intermediary connectors. Importantly, whatever coupling arrangement is chosen, the coupling should clearly be suitable to maintain a seal adequate to sustain the negative vacuum pressure for collection of the desired substance.

Turning again to FIGS. 4-6 and in particular FIG. 5, distal end of reservoir 405 is fabricated to include hollow, elongated protuberate member 413 that extends distally from the reservoir wall to include first end port 405*a*. In one preferred embodiment, best seen in FIG. 6, protuberate member 413 also extends proximally into internal chamber 406 a sufficient distance to prevent any captured substances from exiting the reservoir when the vacuum source is turned off or disconnected from the vacuum tool.

As will be further noted from FIGS. 4-6, protuberate member 413 serves as the male portion of a male/female coupling with proximal connector end 403*b* of collection conduit 403. It will be readily appreciated that such an arrangement is merely exemplary and is not intended to limit the invention as an attachment format for the components. More to that end, it will be obvious to those skilled in the art that protuberate member 413 could clearly be fabricated as the female counterpart of such a male/female coupling whereupon the proximal connector end 403*b* of collection conduit 403 would be appropriately sized to insert into protuberate member 413 at first end port 405*a*. Typically, such male/female couplings employ cooperative manufacturing tolerances sized to ensure adequate attachment or utilize materials having suitable elasticity coefficients to accommodate male insertion. Alternatively, such couplings may include friction-based retention tapers or, more preferably, reciprocating threading whereby the male and female counterparts thread into and onto one another, respectively.

Alternatively, collection conduit 403 and any desirable collection tip 409 may be integrally fabricated with capture reservoir 405, such that first end port 405*a* transitions into collection conduit 403 as a unitary structure. Such an arrangement would, however, be considerably more restrictive with regard to ease of operator cleaning and the removal of undesirable obstructions lodged therein. Accordingly, collection conduit 403 and collection tip 409 are preferably fashioned as individual components that are easily detachable from one another and reservoir 405 to allow for cleaning, removal of obstructions or replacement of a new or different collection conduit or collection tip.

Capture reservoir 405 further comprises second end port 405*b* which is available for and capable of attachment to a remote vacuum source 407 by way of a hose or conduit (not shown) that is suitable for maintaining adequate vacuum when the vacuum source is in operation. The attachment of second end port 405*b* to vacuum source 407 may be achieved by any number of well known and suitable attachment schemes such as those discussed above as relating to proximal connector end 403*b* of collection conduit 403 and first end port 405*a*. Turning again to FIGS. 4-6, it can be seen that the exemplified embodiment provides for hollow, elongated protuberate member 415 to extend proximally from the reservoir wall to include second end port 405*b* which serves as the male counterpart of a male/female coupling to a suitable hose or conduit thereby connecting the tool of the present invention with vacuum source 407. Protuberate member may optionally include retention ribs 410 as shown in FIGS. 4-6 in order to provide an additional feature to secure the hose or conduit to the vacuum tool.

Protuberate member 415 may be preferably fashioned to extend distally into internal chamber 406 and attaches to filter 411 by way of filter support 411*a*, the attachment of which can be adequately achieved by any of the coupling configurations discussed herein. More particularly, protuberate member 415 attaches at its distal end to the proximal end of filter 411. Filter 411 comprises filter support 411*a* upon which filter material 411*b* is supported (see FIGS. 6 and 8), further discussion of which is provided below. It will be appreciated that filter support 411*a* may be formed integrally with protuberate member 415 or detachably coupled thereto by any number of well known and suitable attachment schemes such as those discussed herein.

Capture reservoir 405 is preferably fabricated to include operator access to the internal aspect of the reservoir so that the operator may easily retrieve or discard the substance captured therein. Operator access to the captured substance can be effected by any number of configurations readily apparent in the art. Typically, such substance access may be fashioned as a slidable or removable panel or a portal that may opened and closed. Such access should be of suitable size and location about the reservoir wall to adequately remove the substance once it has been collected and captured. Further, such access should be fabricated to achieve sufficient closure in order to maintain adequate vacuum when the tool is in use.

Alternatively, the reservoir itself may be fabricated from two or more sections that may be detachably connected to one another to create the reservoir as shown in FIGS. 4-8. The sections should be detachable from one another to provide adequate substance access and should be re-attachable to one another re-form the reservoir as exemplified in FIG. 5 taken together with FIG. 4 or in FIG. 8.

Turning again briefly to FIGS. 4 and 5, capture reservoir 405 is shown formed by reservoir sections 405*c* and 405*d* which are detachably secured to one another when vacuum tool 401 is properly assembled. The sections detach from one another to provide substance access. Sections 405*c* and 405*d* may be rendered attachable to one another by any suitable means known in the art including reciprocal threading 417 as shown in FIGS. 7 and 8 or, alternatively, any number of snap-together or slidable insertion arrays such as exemplified in FIGS. 4-6 wherein the attachment employs a male/female coupling arrangement operating to secure the sections to one another.

While it is generally contemplated that the capture reservoir should be preferably fabricated with a substance access, it is conceivable that a disposable version of the vacuum tool of the present invention could be manufactured where the entire tool is discarded after use or upon the reservoir reaching its fill capacity. In such a case, it would be optimal to fabricate the tool with cost effective materials such as inexpensive polymers, and preferably one that provides for translucency so enable the operator to adequately monitor the remaining substance capacity of the capture reservoir.

Figure 7:
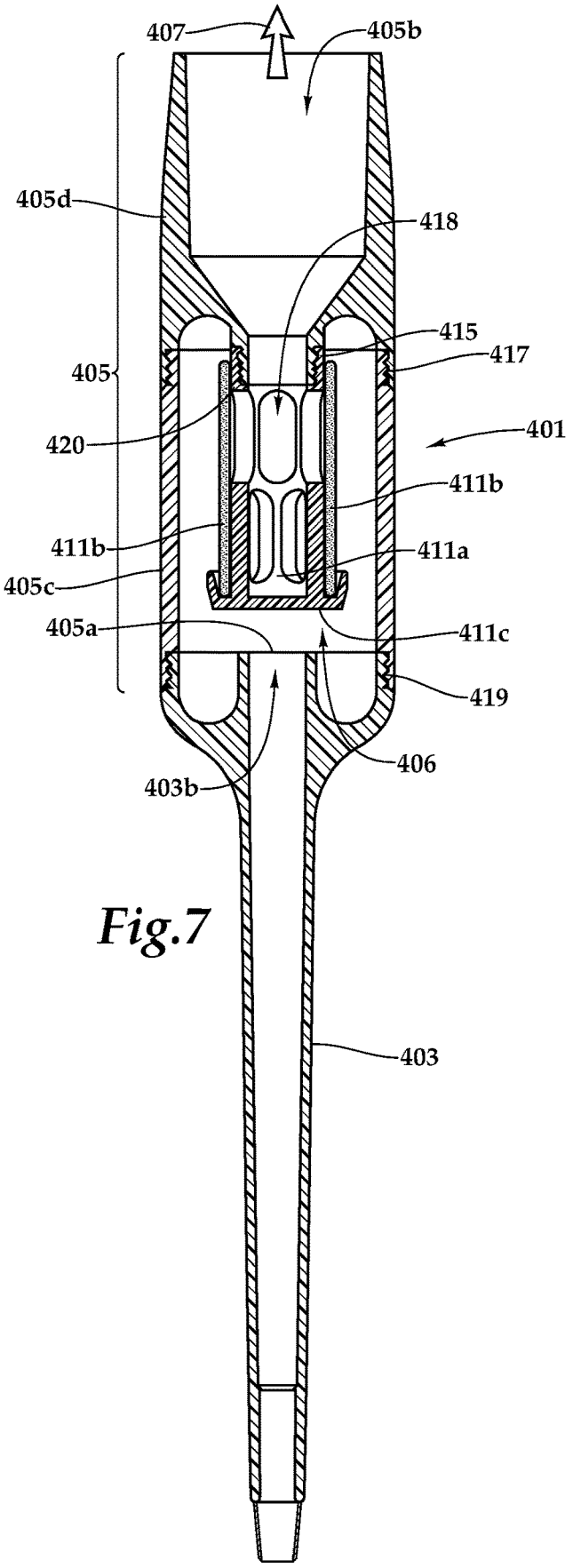
FIG. 7 is a lateral sectional view exemplifying a second embodiment of the handheld vacuum tool of the subject invention.
Figure 8:
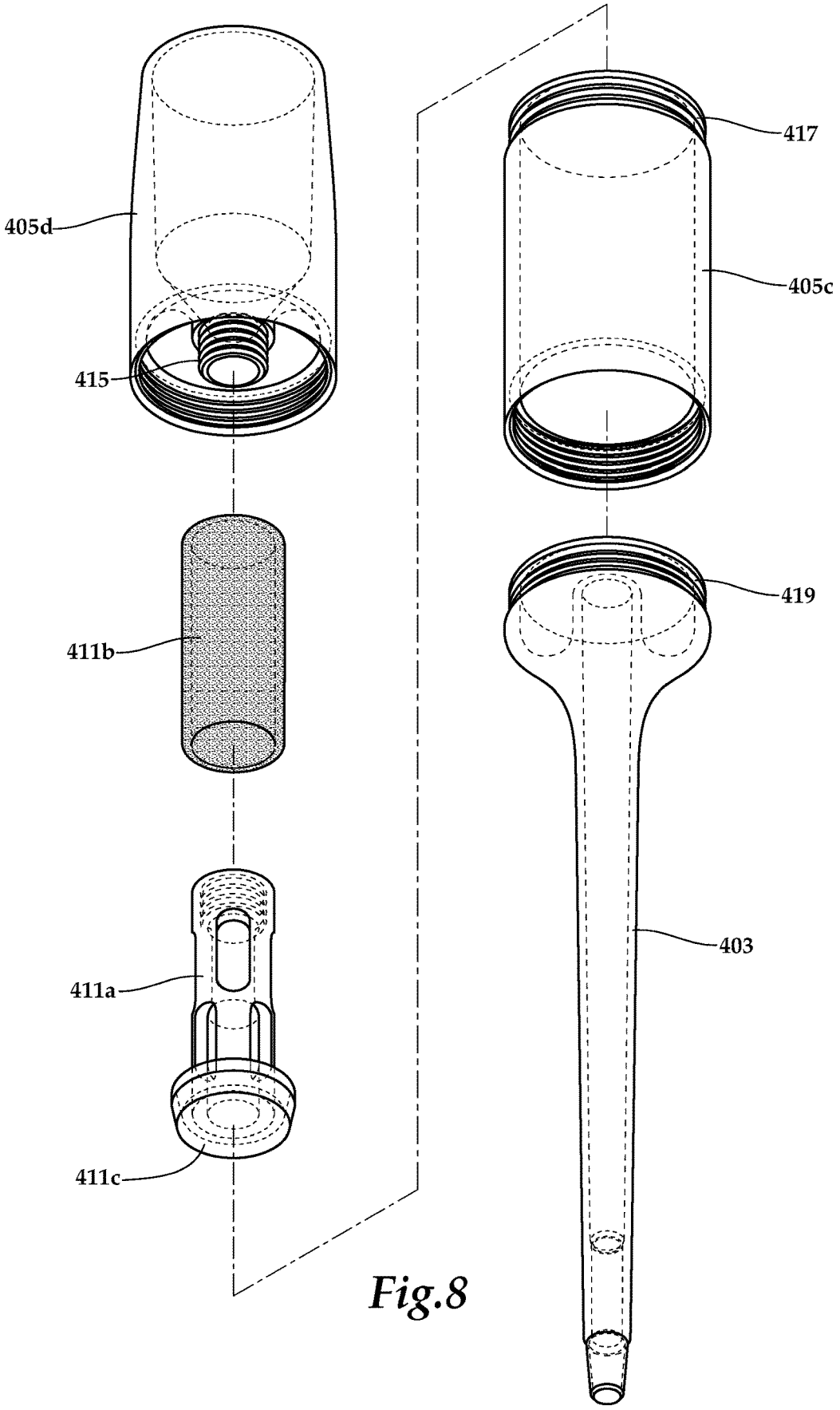
FIG. 8 is a fully exploded perspective view exemplifying a second embodiment of the handheld vacuum tool of the subject invention.

Turning now to FIGS. 7 and 8, another preferred embodiment of the vacuum tool of the present invention is shown. In this embodiment, capture reservoir 405 is fabricated such that first end port 405*a* is created by way of an open distal end fashioned in reservoir section 405*c*. First end port 405*a* is detachably connected to proximal connector end 403*b* of collection conduit 403 which has been appropriately sized to create a sealable attachment with section 405*c* by way of cooperative reciprocal threading 419. Section 405*d* of reservoir 405 is threadably attached to section 405*c* by way of reciprocal threading 417 and includes second end port 405*b* at its most distal aspect. In the embodiment exemplified in FIGS. 7 and 8, hollow, elongated protuberate member 415 extends proximally from second end port 405*b* attaching to filter support 411*a*. Protuberate member 415 serves as threadable male counterpart of a male/female coupling whereby filter support 411*a* is threadably attached to and supported by section 405*d* by way of reciprocal threading 420. It will be appreciated that while the component connections of the embodiment shown in FIGS. 7 and 8 are exemplified using multiple threadable connections, any of such connections may be achieved using the attachment schemes previously described. For example, second end port 405*b* is shown in FIGS. 7 and 8 as the female counterpart of a male/female coupling modified with an insertion taper to receive a hose or conduit in order to connect the tool with vacuum source 407. Notably, second end port 405*b* may be readily sized and/or modified to accommodate any number of commercially available hoses of various diameters.

As mentioned above, filter 411 is preferably comprised of filter support 411*a* and filter material 411*b* as exemplified in FIGS. 7 and 8. It will be appreciated by those skilled in the mechanical and engineering design arts that filter 411 may be constructed using any number of configurations and filter types known in the art and may further be positioned in any number of orientations within the reservoir provided that the resulting filter effectively prevents the substance captured in the reservoir from exiting the reservoir through second end port 405*b* yet simultaneously allowing for sufficient vacuum to be drawn through the tool when in use to collect the desired substance.

In one preferred embodiment, filter 411 is fabricated as a cylindrical, elongate hollow body as shown in FIGS. 4-8, and projects centrally into internal chamber 406 of capture reservoir 405 from by way of attachment to protuberate member 415. In particular, filter 411 attaches at its proximal end to protuberate member 415 and is supported thereby via the coupling between filter support 411*a* and protuberate member 415. It will be appreciated that filter support 411*a* may be formed integrally with protuberate member 415 or detachably coupled thereto by any number of the attachment schemes discussed herein.

Filter support 411*a* preferably includes multiple apertures 418 through which air may effectively pass when a vacuum is drawn through the tool. These apertures may be fabricated in any suitable orientation and size provided that they allow for adequate airflow and do not undermine support for filter material 411*b* or allow it to collapse into the apertures under the negative pressure created by vacuum source 407 when the tool is in use. For example, in FIG. 6, apertures 418 are fabricated as multiple perforations while the apertures shown in FIGS. 7 and 8 are fabricated as slots longitudinally positioned about the filter support.

Filter material 411*b* may be comprised of any suitable filtering material commercially available in the art so long as it is selected with the appropriate porosity to ensure adequate air flow under the force of vacuum while simultaneously preventing the substance captured by the reservoir from entering second end port 405*b*. For example, a filter material with a smaller porosity should be selected in the event that the vacuum tool is intended to collect a fine particulate rather than a substance comprised solely of larger particles.

In the event that filter 411 is to be configured as a cylindrical, elongate hollow body as shown in FIGS. 4-8, filter support 411*a* will be fabricated accordingly to serve the supporting structure about which filter material 411*b* is mounted. Filter material 411*b* is preferably fashioned to approximate a "sock" or "sleeve" that may be snugly fitted over or around support 411*a*, respectively. Preferably, the material selected will embody some elasticity so that it is capable of being snugly and secured mounted on the support.

For example, in the embodiments shown in FIGS. 4-6, filter material 411*b* (not shown) will be preferably formed as a sock that may slide over filter support 411*a* while the embodiment shown FIGS. 7 and 8 provides for filter material 411*b* to be preferably formed in the shape of a sleeve that will similarly slide over the support. It will also be noted that while filter support 411*a* may optionally terminate distally in an open port or a distal wall having apertures, it is generally preferable to have this portion of the support closed off or capped to reduce undesirable accumulation of the captured substance at this position due to the increased force of vacuum associated with linear airflow. Accordingly, apertures 418 are preferably located only along the longitudinal axis of the filter support. In particular, FIG. 6 shows distal wall of filter support 411*a* as a solid wall while FIGS. 7 and 8 show filter end cap 411*c* seated into the support to cap the distal end of the support and to further secure filter material 411*b*.

Additionally, in another preferred embodiment, the tool may optionally comprise a vacuum adjustment regulator as discussed above to reduce the intensity of the vacuum to which the substance to be collected is exposed. Various vacuum adjustment regulator designs are well known in the art of vacuum tool hand pieces and typically reduce the vacuum by providing at least one or more additional ambient air apertures located in any number of suitable positions about the tool whereby additional ambient air may be drawn in through the aperture(s). Accordingly, such apertures function to reduce the vacuum at the distal collection end of the tool. Typically, these apertures are covered with a sliding or rotating member that can be easily manipulated by the operator to entirely or partially cover the aperture in order to adjust the strength of the vacuum at the distal collection end of the collection conduit.

The vacuum tool of the present invention may be formed by any number of acceptable and readily available manufacturing techniques well known to the engineering and design arts including 3D printing, injection molding and the like. Suitable materials for the device range from polymeric materials to metallic alloys and carbon fiber materials however polymeric materials are typically preferred due to lower cost and improved workability of the materials. Such polymers may include but are not limited to thermosetting polymers, thermoplastic polymers, cross-linking polymers, and mixtures thereof. It will be readily apparent to those skilled in the polymeric arts that selection of an appropriate polymer or copolymer should be such that the resulting polymeric matrix is of sufficient durability and rigidity. For example, a suitable capture reservoir may be formed from standard blow-molded polymers to form the capture reservoir sections 405*c* and 405*d* shown in FIGS. 4-8.

Collection conduit 403, optional collection tip 409 and filter support 411*a* can likewise be formed from suitable polymeric materials. While collection tip 409 may be formed from the same material as collection conduit 403 and filter support 411*a*, it may be desirable to form the tip from a more flexible polymer to optimally achieve the desired result. Collection tips for use with the vacuum tool of the present invention are interchangeable as discussed above in the instant application. Additionally, it will be appreciated that the polymeric material may selected to render either opaque, translucent or partially translucent components. Translucent polymers may preferable in instances where the operator opts to visually monitor the contents of the capture reservoir or check for obstructions.

The vacuum tool of the present invention may be utilized in any number of ways to collect and capture either a liquid or solid substance. For example, the tool may be used to remove and collect unwanted debris or refuse so long as the tool is suitable for the size and nature of the substance to be collected as well as the type and strength of the vacuum source employed. While the substance to be collected is typically refuse or debris to be removed or extracted from a desired work area or assembly site, the vacuum tool of the present invention is similarly useful to collect and capture substances to be retained, as for example fine particulates or tiny gemstones dropped by a jeweler.

Moreover, while the vacuum tool of the present invention may be fabricated in any number of sizes, it is typically of a size suitable for use by craftsman such as woodworkers and, in particular, woodworkers that assemble components using wood glues and other similar adhesives. Typically, woodworkers as well as other industries (e.g., furniture assembly or manufacturing operations) utilize fluid adhesives during the assembly and manufacturing process wherein excess adhesive may seep or ooze from a joint when an adhesive is used to affix components to one another. The vacuum tool of the present invention is ideal for removing this type of excess adhesive as well as a variety of other substances such as excess caulking, excess silicone and the like. Importantly, craftsman and others working in these industries, especially when performing jobs requiring fine detail work, would find tremendous benefit from a vacuum tool that avoids the need for cumbersome collection containers such as those seen in the small, portable wet-dry shop vacuums available today.

Accordingly, the present invention also provides a method for collecting a substance that comprises providing an elongated, hollow collection conduit with a distal collection end and a proximal connector end to connect the conduit to a capture reservoir. The method further comprises providing the reservoir with a first end port for attachment to the connector end of the collection conduit and providing the reservoir with a second end port capable of attachment to a remote vacuum source by way of a hose or conduit. The method further includes providing a suitable filter disposed within capture reservoir between the internal aspect of the reservoir and the second end port to prevent the captured substance from entering the vacuum source.

This disclosure relates to and describes certain embodiments that are provided to exemplify the concept of the invention and are not limiting. The description and drawings are intended to provide enabling disclosure to a person of ordinary skill in the art, whose knowledge would provide for modifications that would readily be understood to fall within the scope and spirit of the invention, without undue experimentation.

The invention claimed is:

1. An article of manufacture for removing and collecting excess fluid adhesive during fabrication or construction of an apparatus comprising one or more components assembled and affixed together using said fluid adhesive, said article of manufacture comprising:

a reservoir, and a collection tubing, wherein said reservoir and collection tubing are in vacuum communication with a vacuum source during use and, together, are portable, and wherein the reservoir serves as a collection container for the fluid adhesive and comprises a removable lid having a vacuum port for connecting to the vacuum source, and a filter disposed on an inner face of the lid to prevent fluid adhesive from. contaminating the vacuum source or motor, said reservoir or lid comprising an inlet port for receiving one end of the collection tubing.

2. The article of claim 1, wherein the inlet port comprises a quick-release coupling to facilitate attachment or detachment of the collection tubing to or from the inlet port by a user.

3. The article of claim 1, wherein the vacuum source is portable.

4. The article of claim 1, wherein the vacuum source and reservoir are affixed together to form a single portable unit.

5. The article of claim 1, wherein the collection tubing further comprises a detachable collection tip.

6. A method of collecting and removing from a surface, excess fluid adhesive, said method comprising the steps of a) providing an article of manufacture of claim 1, and b) operating the article of manufacture to collect and remove from a surface, excess fluid adhesive.

7. The method of claim 6, wherein the excess fluid adhesive is liquid glue used in the fabrication or manufacture of furniture.

8. A portable, unitary system for removing and collecting excess fluid adhesive during fabrication or construction of an apparatus comprising one or more components assembled and affixed together using said fluid adhesive, said system comprising:

a portable vacuum source a portable reservoir, and a collection tubing, wherein said vacuum source, reservoir and collection tubing are in vacuum communication with one another during use, and wherein the reservoir comprises a removable lid forming an air-tight seal during use, said lid having a vacuum port and a filter disposed on an inner face of the lid, said reservoir or lid comprising an inlet port for receiving one end of the collection tubing.

9. A handheld vacuum tool for collection of a substance, said vacuum tool comprising:

an elongated, hollow collection conduit having a distal collection end and a proximal connector end;

a capture reservoir defining an internal chamber disposed therein, the reservoir having a first end port and a second end port, said first end port being coupled to the proximal connector end of the collection conduit, and said second end port being capable of attachment to a remote vacuum source, the collection conduit and the vacuum source both having an open air communication with the internal chamber of the reservoir when the tool is attached to the remote vacuum source; and a filter disposed within the capture reservoir between the internal aspect of the reservoir and the second end port.

10. The vacuum tool of claim 9 wherein the capture reservoir is cylindrical.

11. The vacuum tool of claim 10 wherein the capture reservoir comprises an external handgrip surface.

12. The vacuum tool of claim 9 wherein the capture reservoir includes a reservoir wall comprising a substance access.

13. The vacuum tool of claim 12 wherein the capture reservoir is comprised of at least two sections detachably connected to one another.

14. The vacuum tool of claim 12 wherein the capture reservoir is comprised of at least two sections detachably connected to one another by reciprocal threading.

15. The vacuum tool of claim 9 wherein the filter comprises a filter material disposed about a filter support that is attached to the capture reservoir.

16. The vacuum tool of claim 15 wherein the filter support is comprised of an elongate body having a first end attached to the capture reservoir and a second end that terminates in the internal chamber of the reservoir.

17. The vacuum tool of claim 9 wherein the collection conduit further comprises an attachable collection tip.

18. The vacuum tool of claim 9 wherein the collection conduit is detachably connected to the capture reservoir by reciprocal threading.

* * * * *